United States Patent [19]

Legon

[11] Patent Number: 4,827,632

[45] Date of Patent: May 9, 1989

[54] SKI BOOT

[75] Inventor: Fabrice Legon, Seynod, France

[73] Assignee: Salomon S. A., Annecy, France

[21] Appl. No.: 138,488

[22] Filed: Dec. 28, 1987

[30] Foreign Application Priority Data

Dec. 30, 1986 [FR] France ..... 86 18499

[51] Int. Cl.[4] ..... A43B 5/04

[52] U.S. Cl. ..... 36/119; 36/88; 24/270

[58] Field of Search ..... 36/117–121, 36/50, 88; 24/270, 271, 273, 514, 515, 516

[56] References Cited

U.S. PATENT DOCUMENTS

| | | | |
|---|---|---|---|
| 4,192,087 | 3/1980 | Salomon | 36/119 |
| 4,205,467 | 6/1980 | Salomon | 36/119 |
| 4,492,005 | 1/1985 | Begley et al. | 24/270 |
| 4,575,956 | 3/1986 | Paris | 36/119 |

FOREIGN PATENT DOCUMENTS

| | | | |
|---|---|---|---|
| 2547206 | 12/1984 | France | 36/119 |
| 2547487 | 12/1984 | France | 36/119 |

*Primary Examiner*—James Kee Chi

*Attorney, Agent, or Firm*—Pollock, Vande Sande & Priddy

[57] ABSTRACT

Rigid shell ski boot (1) comprising a quick-tightening, quick-release foot-retaining system operable by means of a lever (9) that is angularly pivotable about an axis of articulation (15) into two extreme positions that correspond to tightening and release, respectively. The lever (9) controls an assembly composed of a threaded sleeve (6) and a nut (7) joined to an element (8) for support of a skier's foot through a movable cam (10) that forms part of the lever (9). The relative position of the cam (10), which is a function of the angular position of the lever (9), determines the position of the sleeve-nut (6, 7) assembly and either grips or release the foot.

12 Claims, 3 Drawing Sheets

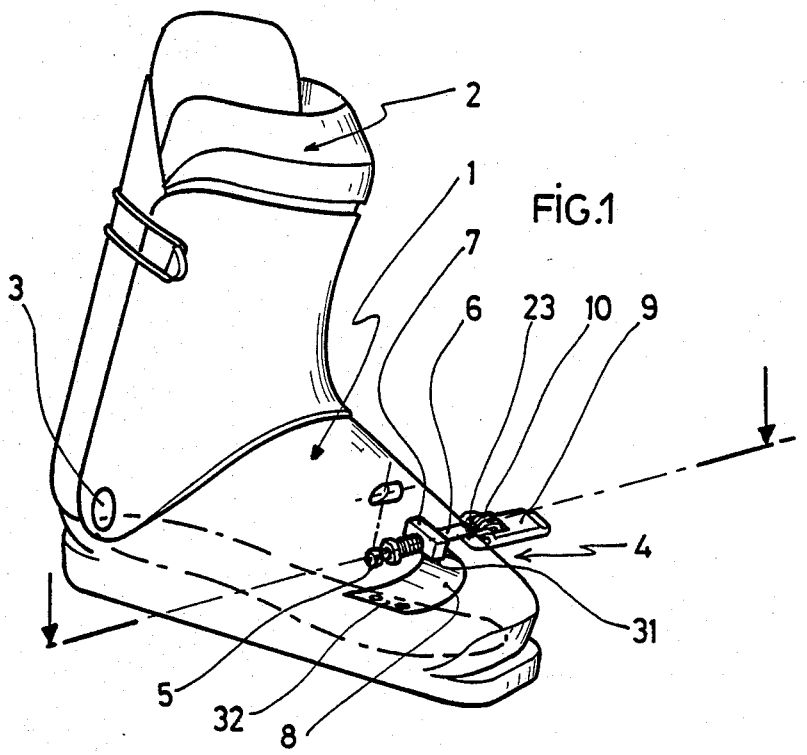
FIG.1
FIG.2
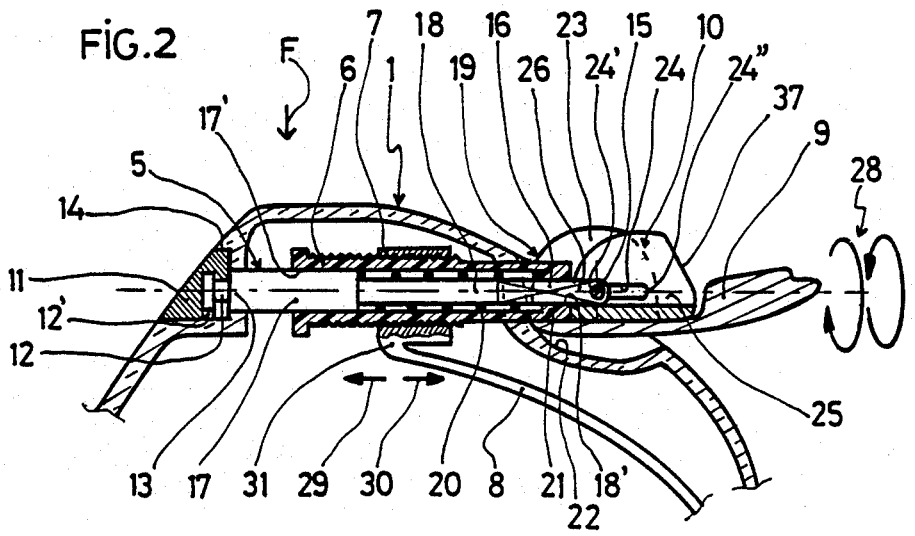

25
10
9
6
19
22
40
1

SKI BOOT

FIELD OF THE INVENTION

The invention relates to rigid-shell ski boots comprising at least one foot-retaining system arranged within said shell and operable from the exterior of said shell.

BACKGROUND OF THE INVENTION

Known rigid-shell ski boots of this type generally comprise foot-retaining systems arranged within the front part of the boot, corresponding essentially to the metatarsal region of the foot. Such retaining systems are most often operated from outside the rigid shell by means of a two-position lever, one position of which is known as the "unlocked" position, and the other as the "locked" position. Moving from one of these settings to the other produces quick tightening or quick release of the boot. For example, the ski boots described in French Pat. Nos. 2,547,487; 2,468,322; and 2,467,559 show foot-retaining systems of this type comprising, inter alia, an eccentric or cam-equipped lever that acts either on the translational position of a threaded sleeve to which the foot-retaining unit is connected, or, simultaneously, on the translational position of a threaded sleeve connected to a retaining element and on the position of a support shank carrying a nut connected to another foot-retaining element. To adjust the foot-retention setting on such systems, the lever is first shifted into the "unlocked" position, corresponding to a quick release by rotation of the cam, following which it can be screwed in one direction of the other, causing the threaded sleeve to move and thereby adjusting the foot-retaining element connected to said sleeve.

In the constructional examples described above, the cam-equipped or eccentric levers, when in "locked" position, expose a relatively large space together with the recesses in which they are housed on the rigid shell. This space, which corresponds to the travel of the cam, is aesthetically unappealing but cannot be reduced without producing a corresponding reduction in the length of travel of the cam. This, however, is undesirable, since it is the travel of the cam that determines the range of the quick-release means.

SUMMARY OF THE INVENTION

The invention is designed to cure the above drawback in a simple and effective way. This is done by means of a cam that is movable in translation but stationary in rotation with respect to the actuating lever, so that regardless of its position said lever never loses contact with the bottom of the lever housing in the shell. The cam alone varies in position. Another advantage resides in the fact that the cam may be made of a different material than the lever; in particular, the cam may be formed from a material having mechanical properties superior to those of the lever, which in turn may be made of ordinary materials, thereby reducing costs.

According to the invention, the foot-retaining system comprises:

- a threaded sleeve sliding over a lever-support shank;
- a nut cooperating with the threaded sleeve and connected to at least one support element placed between the shell of the boot and the foot of a skier so as partially to surround the latter;

- a lever articulated upon the end of the shank by means of a hinge pin;
- a cam, traversed by said pin, and capable of moving in translation over the lever by means of an oblong slot and guide means, the latter two elements being parallel to each other; and
- elastic means, such as a spring, carried by the lever-support shank and designed to apply the threaded sleeve against the cam.

The cam is guided along the lever by a rectilinear sectional piece that matches the shape of a groove in said lever, and by the hinge pin of the lever, which passes transverse through the oblong slot. Said slot, and the matching guide pieces for cam and lever are parallel to the lever-support shank only when the lever is placed in its so-called unlocked position. Viewed in elevation, the cam has an essentially semicircular profile, the center of the circle coinciding with the hinge pin of the lever and with one of the ends of the oblong slot, which extends out from said center toward the periphery of the cam over a set distance. Said distance corresponds to the translational course of the cam and thus defines the degree of eccentricity the cam is capable of assuming with respect to the hinge pin of the lever. The greater said eccentricity, the more the movement of the threaded sleeve carrying the nut connected to the foot-retaining piece will vary between the "locked" and "unlocked" positions of the lever. It will be noted that obtaining the maximum degree of eccentricity depends above all on the angular clearance imparted to the rotating cam by movements of the lever onto which it is fitted. Because the oblong slot and the guide means of the cam are parallel to each other and to the longitudinal axis of the lever-support shank, when the lever is in "unlocked" position, the maximum theoretical angular clearance is 180°. In order to obtain a clearance that is as close as possible to this 180°, the lever will advantageously be designed so as to pivot toward the upper rather than the lower portion of the shell bottom, since in said lower portion the angle of clearance falls within the range of approximately 30° to 60°. Thus, when the lever is in "unlocked" position, the movable cam is pushed in a direction parallel to the longitudinal axis of the lever-support shank by means of the threaded sleeve, which is subjected to the action of the spring, until said cam comes to abut the hinge pin of the lever at the corresponding end of its oblong slot. Because the hinge pin of the lever remains stationary with respect to the lever, the cam alone is moved off center. When the lever is clamped down against the shell of the boot in "locked" position, the movable cam first pivots about the hinge pin of the lever at the end of the slot on which it bears, and, by the effect of its circular profile moving off center with respect to said hinge pin, pushes the threaded sleeve back against the force of the spring. When the angle of inclination of the oblong slot has become relatively close to the longitudinal axis of the lever-support shank and has assumed a direction that is convergent with the thrust of the spring, the cam slides simultaneously on the hinge pin and on the lever under the effect of said spring, which forces back the threaded sleeve, as the other end of the cam slot comes to abut the hinge pin of the lever.

According to one embodiment of the invention, the semi-circular cam profile includes a flat section located on the side opposite the oblong slot and corresponding to the end of the threaded sleeve when the lever is "locked" against the shell of the boot. According to another embodiment, the lever and/or movable cam comprise a recessed section designed to fit together with a correspondingly shaped part on the shell when the lever is clamped down against the shell of the boot. Advantageously, these shaped pieces are designed to snap together through the elastic deformation of one or both of the pieces.

BRIEF DESCRIPTION OF THE DRAWINGS

The invention will be better understood with reference to the following description and to the attached drawings, which illustrate, by way of example, several embodiments of the foot-retaining device.

FIG. 1 is a view in perspective of a rigid shell ski boot comprising a foot-retaining system according to the invention.

FIG. 2 represents in detail the foot-retaining system of FIG. 1, viewed in partial cross-section along line II—II.

DESCRIPTION OF PREFERRED EMBODIMENT

Figure 3:
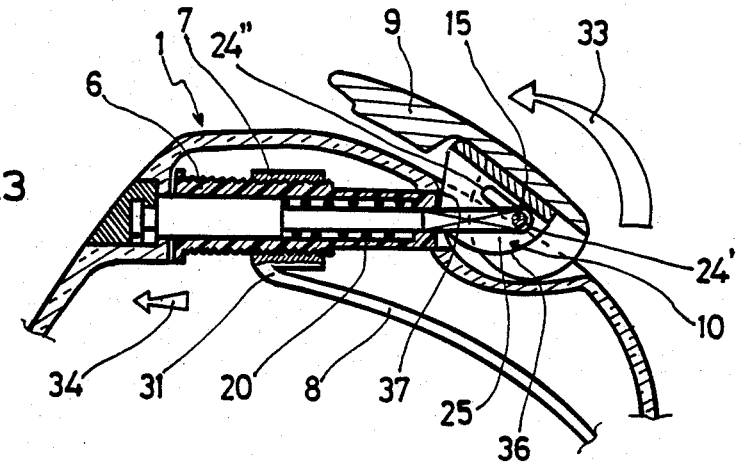
FIGS. 3 and 4 illustrate the operation of the foot-retaining system as the lever is clamped down in the direction of a quick tightening and locked in position on the shell of the boot.

In a manner known per se, the ski boot of FIG. 1 comprises a shell bottom 1 below a top portion 2 of a boot, said top portion being at least partially articulated on said shell bottom about a mounting rivet 3 positioned in the region corresponding approximately to the malleoli of the skier. For the sake of a better understanding of the drawings, the various parts making up the foot-retaining system are shown in bolder lines than is the rest of the boot. The foot-retaining system is positioned in the front part 4 of shell bottom 1, corresponding essentially with the metatarsal region of the foot. The system comprises:

- a lever-support shank 5 at right angles to the shell bottom 1 of the boot which limits its translational motion;
- a threaded sleeve 6 sliding over said lever-support shank;
- a nut 7 cooperating with the threaded sleeve and connected inter alia to at least one support element 8 placed between the shell of the boot and the foot of a skier so as partially to surround the latter;
- a lever 9 articulated upon the end of lever-support shank 5; and
- cam 10 capable of moving in translation over lever 9.

The cross-sectional view along line II—II of FIG. 1, represented in FIG. 2, provides greater detail concerning the arrangement of the various parts making up the foot-retaining system described hereinabove. It will be noted that the translational motion of lever-support shank 5 over shell bottom 1 is limited at ends 13 and 16 of said shank, which are retained by abutting both sides of said shell bottom. End 13, which is provided with a throat 12, is retained at one side of shell bottom 1 by means of a cylindrical plug 11 which comprises transverse fluting 12′ corresponding to the profile of end 13. Said cylindrical plug 11 is fitted over said end 13 and inserted into a cylindrical recess 14 provided in shell bottom 1. Said plug 11 constitutes one of the elements that limit the translational motion of lever-support shank 5. End 16 of said shank supports lever 9 which, through hinge pin 15 and pivoting section 19 (two parts of lever 9 that come to abut shell bottom 1), constitutes the second of the elements designed to limit the translational motion of lever-support shank 5. Lever-support shank 5 is composed of two cylindrical spans 17 and 18 of different diameters, corresponding to ends 13 and 16 respectively, over which slides a threaded sleeve 6 containing bores 17′ and 18′, corresponding to the diameters of said cylindrical spans 17, 18. A spring 20 fitting over cylindrical span 18 exerts its force between cylindrical span 17 of lever-support shank 5 and a shoulder 21 marking the end of threaded sleeve 6 in the direction of hinge pin 15 of lever 9. Pivoting section 19 of said lever 9 is generally spherical in shape and matches the shape of cavity 22 in shell bottom 1, within which piece 19 comes to rest. In accordance with the invention, movable cam 10 is mounted to slide on lever 9, to which it is connected by means of hinge pin 15, which passes through an oblong slot 24 in said cam. Said cam is further guided over said lever by the sides of a notch 23 cut into pivoting section 19 of the lever, along its longitudinal axis and in the extended portion of lever-support shank 5, opposite the corresponding end of threaded sleeve 6. Oblong slot 24 in movable cam 10, which parallels the means by which said cam is guided over lever 9, determines the course of the translational motion of said movable cam 10, while hinge pin 15 of lever 9 serves as a stop for ends 24′, 24″ of slot 24. Movable cam 10 is provided with a longitudinal groove 25 the bottom of which is parallel to and below oblong slot 24 so as to accommodate at least the end 16 of lever-support shank 5 when lever 9 is in "unlocked" position. The outer profile 36 of said cam is in the form of a circle the center of which coincides with end 24″ of slot 24 (said end 24″ being juxtaposed with hinge pin 15 of lever 9, and of pivoting section 19). Preferably, the circular shape of outer profile 36 of movable cam 10 corresponds to the spherical shape of pivoting section 19 of lever 9.

Lever 9 can be used to rotate threaded sleeve 6 by means of lever-support shank 5, one end 16 of which is equipped with two flat drive bars 26, which cooperate with corresponding opening 18′ bored into the end of said threaded sleeve in the vicinity of shoulder 21. When in "unlocked" position, lever 9 can be rotated as shown by arrows 28, thereby causing threaded sleeve 6 to revolve within nut 7, which becomes tighter or looser, as shown by arrows 29 and 30, depending on the direction of rotation of the lever. In the course of its motion in the direction of arrows 29 or 30, nut 7 draws with it upper end 31 of support element 8, while lower end 32 of said element 8 remains stationary with respect to shell bottom 1, to which it is fastened by known means such as rivets, stitches, glue, etc.

Figure 4:
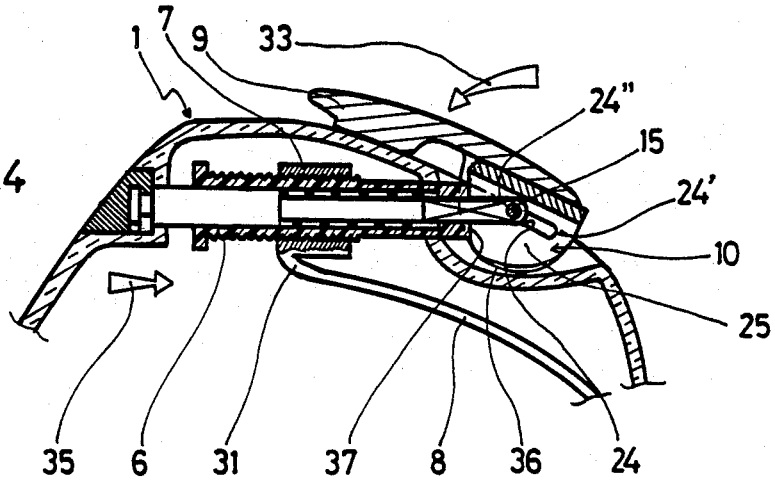

After the position of support element 8 has been adjusted (FIGS. 2 and 3), lever 9 is pushed toward the top of shell bottom 1 in the direction shown by arrow 33. Lever 9 turns on hinge pin 15, drawing movable cam 10 along with it. The latter, pivoting about said pin 15 at the bottom 24′ of slot 24, forces threaded sleeve 6 into shell 1 to a distance corresponding essentially to its degree of eccentricity, which in turn depends on the length of slot 24. In the course of its motion in the direction of arrow 34, threaded sleeve 6 compresses spring 20 and pulls on upper end 31 of support element 8. Under the effect of the thrust of spring 20 and/or the foot of a skier when the boot is being worn, threaded sleeve 6 tends to push back movable cam 10. When the angle of inclination of said cam, and thus of oblong slot 24, forms an angle that is relatively acute with respect to the longitudinal axis of the shank—at least sufficiently acute to exceed the limit of slippage resistance between slot 25 and pin 15 and between the guideways of cam 10 on lever 9—movable cam 10 slides over lever 9 until bottom 24'' of slot 24 comes to abut hinge pin 15. Preferably, the extreme position of retraction of cam 10 with respect to lever 9 corresponds to the position in which lever 9 is locked against shell bottom 1, as depicted in FIG. 4. According to a preferred embodiment of movable cam 10, said cam is provided with a flat secant surface 37 intersecting the exterior circular profile 36 of said cam. Said flat surface in turn makes contact with the end of threaded sleeve 6 by virtue of the continuous effect of spring 20 between shank 5 and said sleeve 6. Thus in "locked" position, lever 9 is elastically retained against shell bottom 1.

Figure 5:
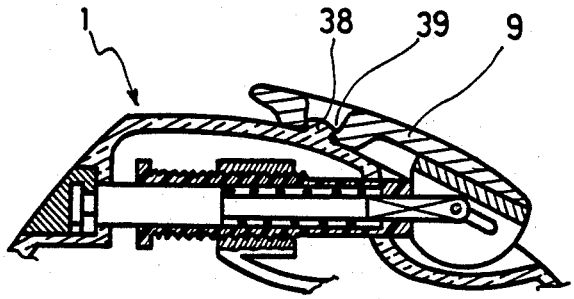
FIG. 5 represents an embodiment of the foot-retaining system provided with a lever that is secured in "locked" position on the shell.

As shown in FIG. 5, lever 9 may also be held in its "locked" position against shell bottom 1 by means of a clipping system. In this example, a protruding stud 38 integral with shell bottom 1 and shaped essentially like a mushroom constitutes the means for retaining lever 9. The latter contains a recess 39 the rim of which is slightly smaller in diameter than the diameter of the stud and is capable of deforming elastically when it is snapped onto stud 38.

Figure 6:
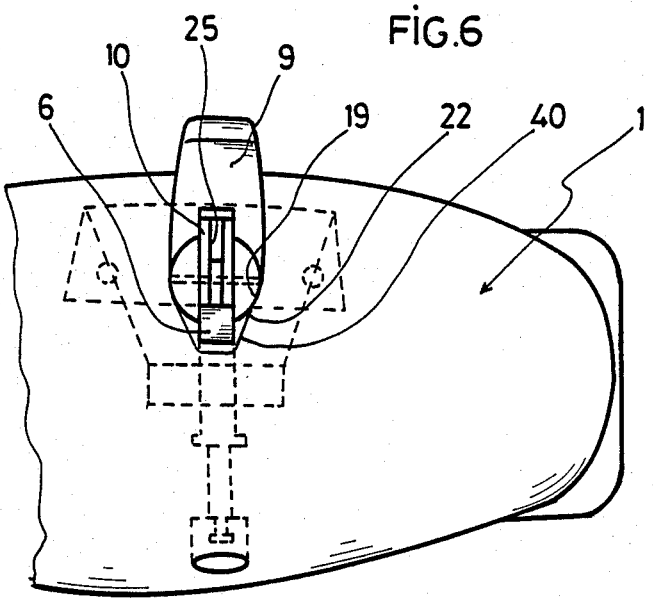
FIG. 6 is a top view of the foot-retaining system along arrow F of FIG. 2.

FIG. 6 depicts the special shape of the cavity 22 which houses pivoting section 19 of lever 9 within shell bottom 1. Cavity 22 comprises, inter alia, a spherical portion that corresponds to the zone of contact and articulation of pivoting part 19 of lever 9, and a narrowed zone 40 in the general shape of a "V" truncated at its base, said zone narrowing inward into shell bottom 1. At the base of narrowed zone 40, the corresponding end of threaded sleeve 6 and movable cam 10 move freely. Said narrowed shape 40 is designed to allow lever 9 to be clamped down against shell bottom 1 while preventing movable cam 10 from coming to rest on the surface of the shell bottom before it has pivoted to a degree sufficient to allow it to retract along the length of oblong slot 24.

What is claimed is:

1. Ski boot comprising a rigid shell (1) within which is arranged a foot-retaining system, said system comprising at least one support element (8) positioned between said shell and the foot of a skier so as partially to surround said foot, and means for adjusting the position of said support element with respect to the foot, said adjustment means being controlled by means of a lever (9) controlling an assembly consisting of a threaded sleeve (6) and a nut (7), said assembly being attached to said support element (8) and movable in translation along a shank (5) that is secured to said shell (1), wherein the lever comprises a cam (10) against which said threaded sleeve (6) is continuously applied by the action of elastic means (20) carried on said shank (5), said cam (10) being movable in translation and pivotable about a hinge pin (15) on said lever (9) through an oblong slot (24) and guide means cooperating with a notch (23) in said lever, said slot (24) and said guide means being parallel to said shank (5) only when said lever (9) is in "unlocked" position.

2. Ski boot according to claim 1, wherein said movable cam (10) presents, viewed in elevation, a profile (36) essentially circular in shape, the center of which coincides with one (24'') of the ends (24', 24'') of said oblong slot (24), which extends rectilinearly from said end (24'') outward toward the periphery of said movable cam.

3. Ski boot according to claim 2, wherein said movable cam (10) comprises a longitudinal groove (25) the bottom of which lies below said oblong slot (24) at a distance corresponding at least to the space required to accommodate an end (16) of said shank (5), onto which said lever (9) is articulated by means of said hinge pin (15), which passes through said end (16).

4. Ski boot according to claim 3, wherein the profile (36) of said movable cam (10) comprises a flat section (37) located on the side opposite said oblong slot (24).

5. Ski boot according to claim 1, wherein said lever (9) comprises a pivoting part (19) that is generally spherical in shape, corresponding at least partially to the shape of an articulational recess (22) provided in the shell (1) of the boot.

6. Ski boot according to claim 1, wherein said pivoting part (19) of said lever (9) comprises said notch (23) for guiding said movable cam (10), said notch constituting the passageway through which said threaded sleeve (6) approaches said movable cam.

7. Ski boot according to claim 1, wherein the translational motion of said shank (5) on said boot shell (1) is limited by means of a plug (11) overlapping one (13) of the ends of said shank, and by pivoting section (19) of said lever (9), which is held within said articulational recess (22)by means of said hinge pin (15) connecting said lever (9) to the other (16) of the ends of shank (5).

8. Ski boot according to claim 1, wherein said shank (5) comprises two cylindrical spans (17, 18) of different diameters corresponding to ends (13, 16) of said shank, respectively, said threaded sleeve (6) being provided with bores (17', 18') matching said cylindrical spans.

9. Ski boot according to claim 1, wherein said elastic means (20) exert their force between said shank (5) and said threaded sleeve (6).

10. Ski boot according to claim 8, wherein one end (16) of cylindrical span (18) of the shank comprises two flat drive bars (26), corresponding to the shape of said bore (18') in said threaded sleeve (6).

11. Ski boot according to claim 5, wherein said spherical articulational recess (22) is extended into a zone (40) that narrows into the shape of a "V" truncated at its base.

12. Ski boot according to claim 3, wherein a stud (38) in the form of a mushroom is integral with said shell (1) in the area over which said lever (9) is clamped when in "locked" position, while said lever contains a recess (39), the dimensions of which are slightly smaller than those of said stud, over which said recess is designed to be snapped elastically.

* * * * *